US007527478B2

(12) United States Patent
Pearce

(10) Patent No.: US 7,527,478 B2
(45) Date of Patent: May 5, 2009

(54) FAN BLADE MOUNTING SYSTEM

(75) Inventor: Richard A. Pearce, Byhalia, MS (US)

(73) Assignee: Hunter Fan Company, Memphis, TN (US)

( * ) Notice: Subject to any disclaimer, the term of this patent is extended or adjusted under 35 U.S.C. 154(b) by 406 days.

(21) Appl. No.: 11/437,442

(22) Filed: May 19, 2006

(65) Prior Publication Data

US 2007/0269314 A1 Nov. 22, 2007

(51) Int. Cl.
*B64C 11/04* (2006.01)

(52) U.S. Cl. ..... 416/210 R

(58) Field of Classification Search ..... 416/5, 416/132 A, 204 R, 205, 207, 210 R, 214 R, 416/220 A; 403/229, 353, 397, 329
See application file for complete search history.

(56) References Cited

U.S. PATENT DOCUMENTS 3,392,848 A * 7/1968 McConnell et al. ..... 211/192
5,944,486 A * 8/1999 Hodgkins, Jr. ..... 416/210 R
6,010,306 A * 1/2000 Bucher et al. ..... 416/210 R
6,039,540 A 3/2000 Wu
6,155,787 A * 12/2000 Hodgkins, Jr. ..... 416/210 R
6,171,059 B1 * 1/2001 Bucher et al. ..... 416/210 R
6,309,183 B1 * 10/2001 Bucher et al. ..... 416/210 R
6,336,792 B1 * 1/2002 Bucher et al. ..... 416/210 R
6,352,409 B1 * 3/2002 Blateri et al. ..... 416/207
6,371,729 B1 * 4/2002 Tseng ..... 416/210 R
6,669,446 B2 * 12/2003 Hodgkins, Jr. ..... 416/210 R
6,758,626 B1 * 7/2004 Tseng ..... 403/408.1
6,802,694 B2 * 10/2004 Bucher et al. ..... 416/210 R
6,857,854 B2 2/2005 Pearce
6,932,576 B2 * 8/2005 Bird ..... 416/207
RE39,448 E * 12/2006 Wu ..... 403/315
7,281,899 B1 * 10/2007 Bucher et al. ..... 416/210 R

* cited by examiner

*Primary Examiner*—Edward Look
*Assistant Examiner*—Aaron R Eastman
(74) *Attorney, Agent, or Firm*—Baker Doneslon

(57) ABSTRACT

A ceiling fan blade iron includes a blade mounting portion 23 with a top surface 26 facing the ceiling, a movable blade fastener 24, and two fixed or stationary mounting catches 27 coupled to and extending from the top surface 26. The blade iron is configured to mate with a blade 15 having two catch mounting holes 17 and a fastener mounting hole 18. Each catch 27 has an upright wall portion 31 and a horizontal top portion 32. The moveable blade fastener 24 has a hand gripping portion 35, a mid-member 36 having an elongated slot 37 therein, an upright abutment portion 38, and a horizontal, outboard extending stop portion 39 extending from the abutment portion. A mounting screw 40 extends through the slot and is threadably received within a threaded mounting hole within the blade iron to allow sliding movement of the fastener relative to the blade iron.

10 Claims, 3 Drawing Sheets

FAN BLADE MOUNTING SYSTEM

TECHNICAL FIELD

This invention relates to ceiling fan blades and blade irons, and specifically to systems for quickly connecting blades to blade irons.

BACKGROUND OF THE INVENTION

Electrically powered ceiling fans typically have a motor mounted within a stationary housing that is suspended from a ceiling. In operation, the motor rotates an annular array of individual extensions in the form of blade irons. Each blade iron is associated with a blade mounted thereto.

Ceiling fans are usually sold at retail with their blades packed separately from the blade irons for compactness. In mounting a ceiling fan, the housing is normally mounted in suspension from the ceiling through a downrod and then the blades are mounted to the blade irons and the blade irons are mounted to the motor.

The blades of ceiling fans are usually coupled to the blade irons by passing mounting screws through holes in the blade and into threaded holes in the blade iron. This task however can be difficult or tedious when the electric motor is already suspended from the ceiling. The difficulty is attributed to the fact that the mounting screws are usually passed from the top of the blade to hide the screw heads from view. The installer must align the holes in the blade with the holes in the blade iron while simultaneously passing the screws through the holes. The installer typically does this from a position below the ceiling fan, thereby limiting the installer's ability to view the mounting holes and thus aligning the mounting holes and drivably rotate the screws.

Accordingly, it is seen that a need remains for a blade that can be quickly and easily mounted to a blade iron. It is to the provision of such therefore that the present invention is primarily directed.

SUMMARY OF THE INVENTION

In a preferred form of the invention a ceiling fan comprising, an electric motor, an annular array of blade irons mounted to the motor with each blade iron having at least one fixed catch having a wall portion and a top portion extending from the wall portion in a first direction along the longitudinal axis of the blade iron. Each blade iron also has a moveable fastener having a wall portion and a top portion extending from the wall portion in a second direction along the longitudinal axis of the blade iron and with the second direction being generally in the opposite direction from the first direction. The moveable fastener being moveable between a locked position locking the blade to the blade iron and an unlocked position unlocking the blade from the blade iron.

The ceiling fan also having a ceiling fan blade associated with each blade iron and having at least one fixed catch mounting hole and at least one moveable fastener mounting hole. With this construction, each respective blade may be mounted to each respective blade iron by passing the fixed catch through the fan blade catch mounting hole and the moveable fastener through the fan blade fastener mounting hole and then moving the moveable fastener from its unlocked position to its locked position.

DETAILED DESCRIPTION

Figure 1:
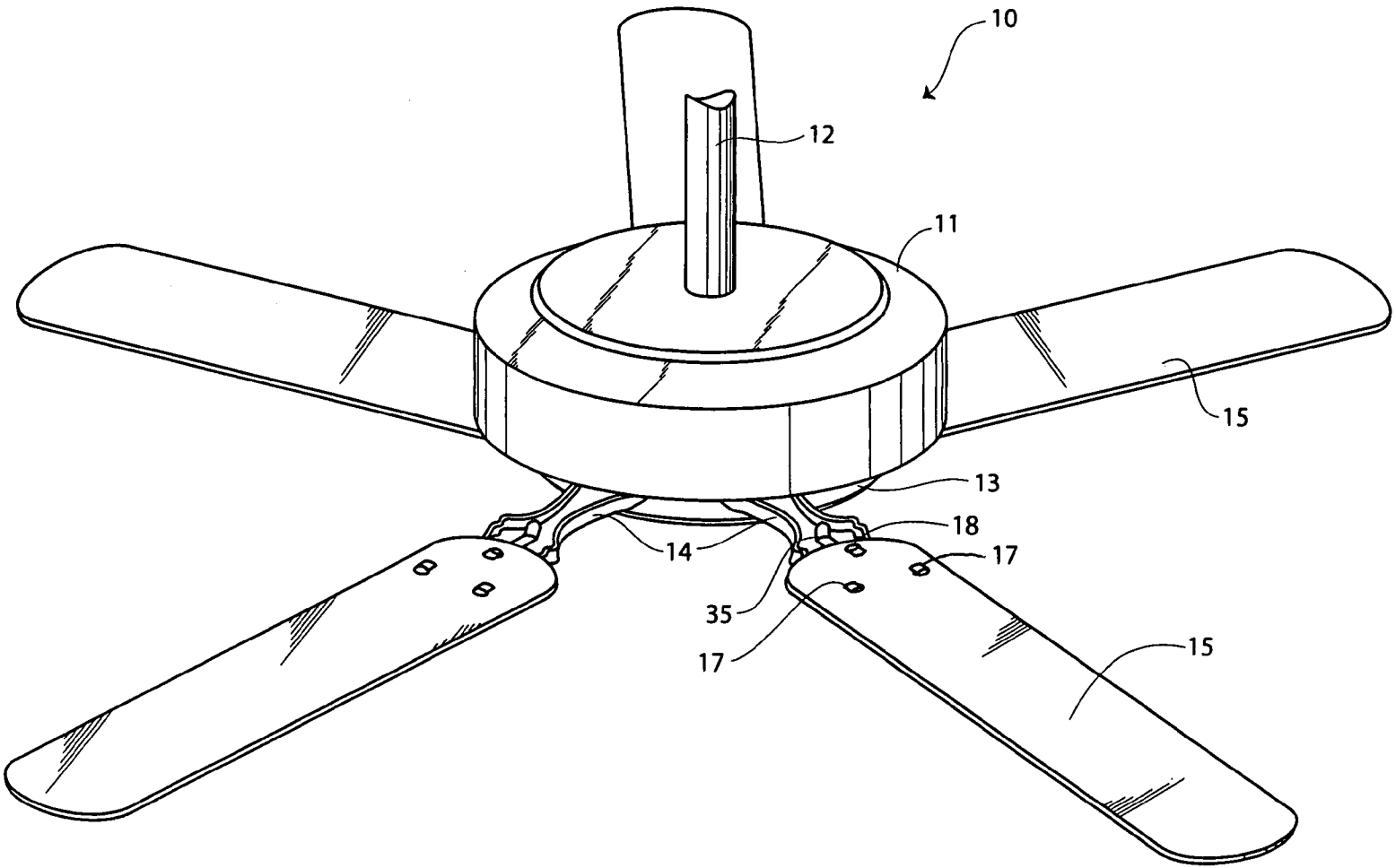
FIG. 1 is a perspective view of a ceiling fan embodying principles of the invention in a preferred form.
Figure 2:
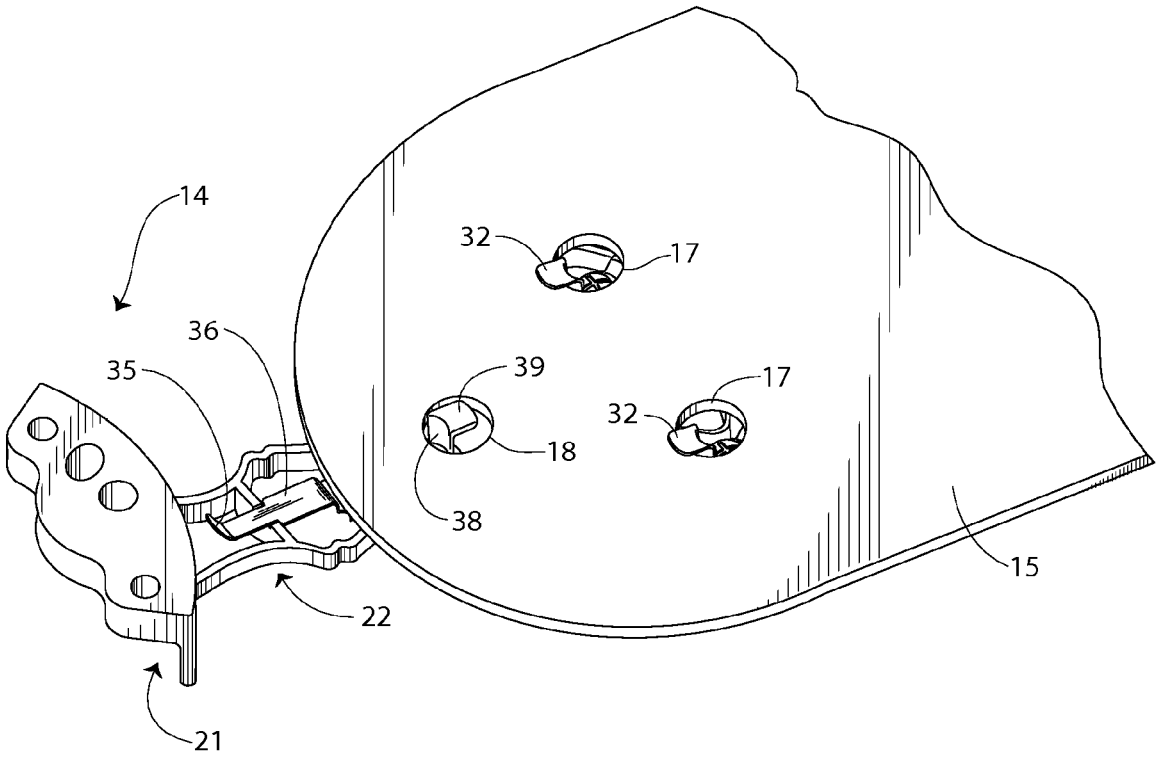
FIG. 2 is a perspective view of a fan blade iron and blade of FIG. 1.
Figure 3:
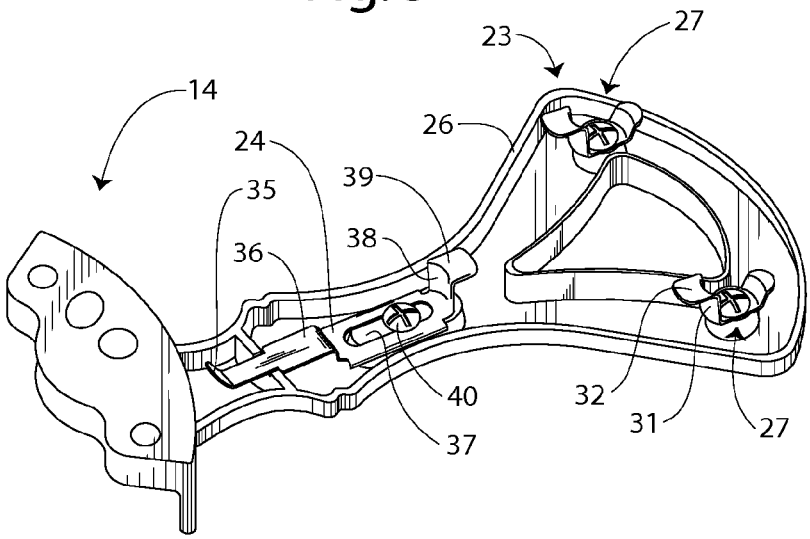
FIG. 3 is a perspective view of the blade iron of FIG. 1.

With reference next to the drawings, there is shown a ceiling fan 10 having a motor housing 11 suspended from an unshown ceiling by a downrod 12. An electric motor 13 is mounted within the housing 11 and connected to a source of electric power by wires that extend through the downrod 12. The motor rotatably drives an annular array of blade irons 14, each having a blade 15 mounted thereto. Each blade has two catch mounting holes 17 and a fastener mounting hole 18 extending therethrough.

Each blade iron 14 has a motor mounting flange 21 configured to be coupled with the electric motor 13 for rotation, a neck 22, and a blade mounting portion 23. The blade mounting portion 23 has a top surface 26 facing the ceiling, a movable blade fastener 24, and two fixed or stationary mounting catches 27 coupled to and extending from the blade iron top surface 26. Each catch 27 has a generally vertical, upright wall portion 31 and a horizontal flange or top portion 32. The horizontal top portion 32 is spaced a select distance from the blade iron top surface 26 through the height of the vertical wall portion 31 so as to catch snugly the blade 15 therebetween. The moveable blade fastener 24 has a hand gripping portion or push plate 35, a mid-member 36 having an elongated slot 37 therein, a vertical, upright abutment portion 38, and a horizontal, outboard extending flange or stop portion 39 extending from the abutment portion 38 and configured to overlay and contact or otherwise engage the top surface of the blade 15. The push plate 35 and mid-member 36 may be considered to be a single push bar. Again, the stop portion 39 is spaced a select distance from the blade iron top surface 26 through the height of the vertical abutment portion 38 so as to catch snugly the blade 15 therebetween. A mounting screw 40 extends through the slot 37 and is threadably received within a threaded mounting hole within the blade iron to allow sliding movement of the fastener 24 relative to the blade iron 14 generally along the longitudinal axis LA of the blade iron.

Figure 4:
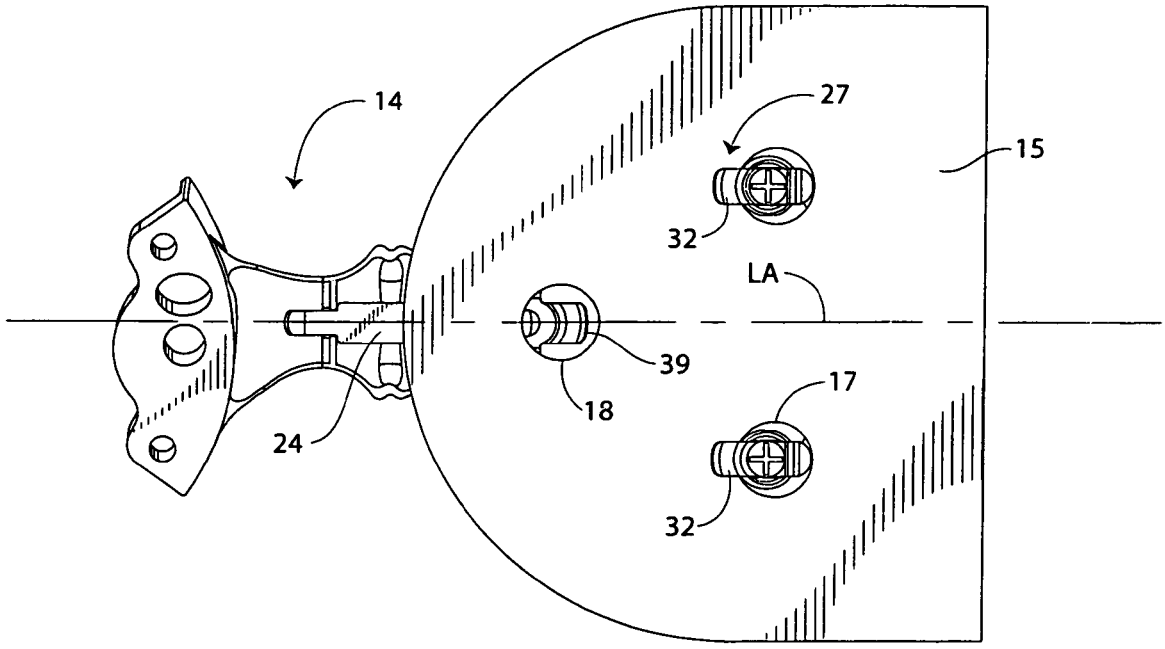
FIG. 4 is a top view of the blade iron of FIG. 1, shown in a disengaged position.
Figure 5:
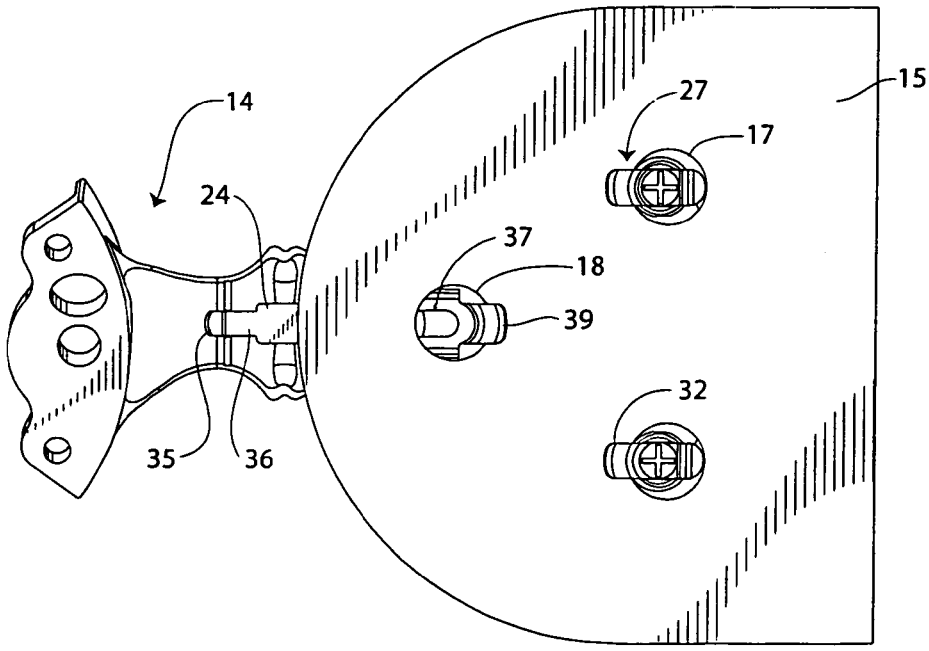
FIG. 5 is a top view of the blade iron of FIG. 1, shown in an engaged position.

In use, the downrod 12 is coupled to the ceiling with the motor housing 11 coupled to the opposite end of the downrod with the blade irons 14 already mounted to the motor 13. With the fastener 24 in its disengaged or unlocked position, shown in FIG. 4, each blade 15 is mounted to a corresponding blade iron by positioning the pair of catches 27 of a blade iron 14 through the blade catch mounting holes 17 and the fastener 24 through the blade fastener mounting hole 18. The blade 15 is then slid outboard so that the catch mounting holes 17 abut the catch vertical wall portions 31. The term outboard is meant to represent movement away from the fan's axis of rotation. The outboard movement of the blade 15 causes the blade to be captured between the blade iron top surface 26 and the horizontal top portion 32 of the catches 27. Next, the fastener 24 is moved or slid longitudinally from its disengaged position to its engaged position, shown in FIG. 5, with the fastener abutment portion 38 abutting the blade fastener mounting hole 18 and the top portion 39 snugly overlying the blade to capture the blade between the blade iron top surface 26 and the stop portion 39. The fastener 24 prevents the upward movement of the blade 15 away from the underlying blade iron 14.

With the fastener 24 locked in position the blade 15 is captured between the two catches 27 and the fastener 24, thereby preventing lateral movement of the blade 15 relative to the blade iron 14, i.e., locking the position of the blade 15 upon the blade iron 14. This locking of the blade may be accomplished simply and quickly by a single installer, as this may be done without the use of tools and without screwing in multiple mounting screws.

The blade 15 may likewise be dismounted from the blade iron 14 by simply moving the fastener 24 back to its disengaged position and moving the blade inboard and then upwardly.

It should be understood that the present invention may utilize only one catch 27 or more than two catches as an alternative to the preferred embodiment. Similarly, the invention may utilize more than the one fastener 24 shown in the preferred embodiment.

It should be understood that the relative positioning of the catch and fastener may be reversed, i.e., the moveable fastener being outboard of the catch. It should also be understood that the orientation of the catch top portions 32 and the fastener stop portion 39 may be turned in the opposite direction along the longitudinal axis of the blade iron, i.e., the catch top portions 32 extending outboardly and the fastener stop portion 39 facing inboardly. However, this is not preferred as the inertial force on the moveable fastener and the outboard extending fastener stop portion aid the fastener in maintaining a locking contact with the blade.

It thus is seen that a quick connect ceiling fan blade is now provided which enables the blade to be mounted and dismounted easily, quickly and in a reliable and secure manner. While this invention has been described in detail with particular references to the preferred embodiments thereof, it should be understood that many modifications, additions and deletions, in addition to those expressly recited, may be made thereto without departure from the spirit and scope of the invention as set forth in the following claims.

The invention claimed is:

1. A ceiling fan comprising, an electric motor;

an annular array of blade irons mounted to said motor, and a ceiling fan blade associated with each said blade iron of said annular array of blade irons, each said blade having at least one fixed catch mounting hole and at least one moveable fastener mounting hole;

each said blade iron having at least one fixed catch having a wall portion and a top portion extending from said wall portion in a first direction along the longitudinal axis of said blade iron, each said blade iron also having a moveable fastener having a wall portion and a top portion extending from said wall portion in a second direction along the longitudinal axis of said blade iron and with said second direction being generally in the opposite direction from said first direction, said moveable fastener wall portion and top portion being slidable along the longitudinal axis in a longitudinal direction between a locked position locking one said blade to said blade iron and an unlocked position unlocking said one blade from said blade iron;

whereby each respective blade may be mounted to each respective blade iron by passing the fixed catch through the fan blade catch mounting hole and the moveable fastener through the fan blade fastener mounting hole and then moving the moveable fastener from its unlocked position to its locked position.

2. The ceiling fan of claim 1 wherein said moveable fastener includes a push bar configured to be contacted by an installer for movement of said moveable fastener.

3. The ceiling fan of claim 1 wherein said first direction extends towards said electric motor and said second direction extends away from said electric motor.

4. A ceiling fan comprising, an electric motor;

an annular array of blade irons mounted to said motor;

at least one catch coupled to each said blade iron;

a ceiling fan blade associated with each said blade iron of said annular array of blade irons, each said blade having at least one catch mounting hole and at least one fastener mounting hole; and a moveable fastener coupled to each said blade iron, said fastener being adapted to extend through said blade fastener mounting hole to releasably lock each said ceiling fan blade to one said blade iron, said moveable fastener having an outboard flange extending stop portion configured to abut a fan blade surface opposite said blade iron, and an abutment portion configured to extend through said blade fastener mounting hole, said moveable fastener outboard flange and abutment portion being slidable along a longitudinal track between a locked position locking said blade to said blade iron and an unlocked position unlocking said blade from said blade iron whereby each respective blade may be mounted to each respective blade iron by passing the catch through the fan blade catch mounting hole and the fastener through the fan blade fastener mounting hole and then moving the moveable fastener to its locked position.

5. The ceiling fan of claim 4 wherein said moveable fastener includes a push bar configured to be manually contacted by an installer for movement of said moveable fastener.

6. The ceiling fan of claim 4 wherein said catch has an inboard extending flange portion.

7. The ceiling fan of claim 6 wherein said catch flange portion extends inwardly towards said electric motor.

8. The ceiling fan of claim 7 wherein said fastener is moveable in a longitudinal direction.

9. A ceiling fan comprising, an electric motor;

an annular array of blade irons mounted to said motor, each said blade iron having at least one catch having an upright portion and an inwardly extending flange extending from said upright portion;

a ceiling fan blade associated with each said blade iron of said annular array of blade irons, each said blade having at least one catch mounting hole and a fastener mounting hole therethrough, and a fastener associated with each said blade iron, each fastener having an upright portion coupled to said blade iron and an outwardly extending flange portion extending from said upright portion, said fastener upright portion and flange portion being moveable along a longitudinal path of travel.

10. The ceiling fan of claim 9 wherein said moveable fastener includes a push bar configured to be manually contacted by an installer for movement of said moveable fastener.

* * * * *